US005263210A

United States Patent [19]

Pollard

[11] Patent Number: 5,263,210

[45] Date of Patent: Nov. 23, 1993

[54] SPACE SAVING BED

[76] Inventor: Trevor S. Pollard, 5908 Pebble Beach Way, San Luis Obispo, Calif. 93401

[21] Appl. No.: 21,587

[22] Filed: Feb. 24, 1993

[51] Int. Cl.[5] ..... A47C 19/20

[52] U.S. Cl. ..... 5/9.1; 5/11

[58] Field of Search ..... 5/8, 9.1, 10.1, 11

[56] References Cited

U.S. PATENT DOCUMENTS

| | | | |
|---|---|---|---|
| 319,711 | 6/1885 | Hazelton . | |
| 1,313,760 | 8/1919 | Teasdale . | |
| 1,945,875 | 2/1934 | Woller . | |
| 2,052,790 | 9/1936 | Norton . | |
| 2,099,621 | 11/1937 | Prescott | 5/8 |
| 2,968,048 | 1/1961 | Roberge . | |
| 3,623,168 | 11/1971 | Rouch . | |
| 3,745,595 | 7/1973 | Nagy . | |
| 3,882,554 | 5/1975 | Glass . | |
| 4,344,195 | 8/1982 | Gustafson . | |
| 4,462,127 | 7/1984 | Schmidt et al. | 5/9.1 |
| 4,837,877 | 6/1989 | Hamada . | |
| 4,922,561 | 5/1990 | Williams | 5/9.1 |

FOREIGN PATENT DOCUMENTS

| | | | |
|---|---|---|---|
| 2241842 | 3/1974 | Fed. Rep. of Germany | 5/9.1 |
| 559647 | 2/1975 | Switzerland | 5/9.1 |
| 1028036 | 5/1966 | United Kingdom | 5/9.1 |

*Primary Examiner*—Michael F. Trettel
*Attorney, Agent, or Firm*—Terry M. Gernstein

[57] ABSTRACT

A space saving bed system includes a base unit and a bed unit. The base unit is supported in place by the weight of materials of which it is constructed. A bed unit, made up of a bed frame with bed legs attached, supports the bedding. A leveraged fold out leg system, one at each corner of the bed, connects the bed frame to the base unit. Hydraulic units and the weight of the base unit act to support and stabilize the bed unit in the raised and stored position and counter balances the weight of the bed, insuring safety and ease in handling it between a stored overhead configuration above a desk, drawing table, clothes storage unit, or the like, and a lowered in-use configuration for sleeping. When the bed is in the overhead storage configuration, locking hinges secure it in position.

17 Claims, 3 Drawing Sheets

SPACE SAVING BED

TECHNICAL FIELD OF THE INVENTION

The present invention relates to the general art of furniture, and to the particular field of convertible furniture.

BACKGROUND OF THE INVENTION

Many people live in small apartments, dorm rooms, or the like. Alternatively, many people share such living spaces. These situations create a crowded environment that may lead to problems.

In order to overcome such crowding problems, the furniture art has included many forms of furniture that can be stored out of the way when not in use. This type of furniture has ranged from the Murphey bed to elevation beds such as disclosed in U.S. Pat. No. 4,837,877, as well as stacking tables and the like.

While somewhat successful in alleviating some space problems, the furniture presently known in the art that is intended to be moved out of the way when not in use has several problems of its own. These problems have inhibited the full commercial acceptance of such furniture.

For example, some of these devices, such as the device disclosed in the aforementioned U.S. Pat. No. 4,837,877, may be complicated to install, operate and service. Furthermore, some of these devices may require substantial modification of room walls, room floors or room ceilings to install. Once installed, such devices may be more or less permanent. Such permanent installation may even require the owner to leave the device once he or she moves out. At any rate, once installed, these devices are quite difficult and onerous to move. Therefore, if there is a change in the living conditions, such as the addition of a roommate, or the like, these devices may not permit enough alteration of the room furniture arrangement to accommodate such changed living conditions.

Still further, since some of these devices are fairly complicated, they may be expensive to purchase and install. They may also be expensive to dismantle or service.

Yet another drawback to many presently-available devices of this sort is the complexity and difficulty in controlling the opening and closing of the device. It may require some dexterity to move the device into the exact position and location desired.

Therefore, there is a need for a space saving furniture piece that is easy to install, operate, alter, dismantle and move, while still being inexpensive to purchase and service.

Objectives of the Invention

It is a main objective of the present invention to provide a collapsing furniture piece that is easy to install, operate, alter, dismantle and move.

It is another objective of the present invention to provide a collapsing furniture piece that is easy to install, operate, alter, dismantle and move while still being inexpensive to purchase and service.

It is a specific objective of the present invention to provide a space saving bed that is easy to install, operate, alter, dismantle and move while still being inexpensive to purchase and service.

SUMMARY OF THE INVENTION

These, and other, objectives are achieved by a space saving bed system having a base unit and a bed unit. A leveraged leg system connects the base unit and the bed unit, and permits the bed unit to be safely and easily raised to an overhead storage position above a desk, drawing table, clothes storage unit, or the like, and be lowered safely and easily for use above the floor at normal bed height.

The bed unit is made up of a metal frame to support the bedding (mattress, etc.), bed legs attached to the bed frame, and a wood frame attached to the bed frame and surrounding the bedding to keep it in place.

The bed unit includes hinges, hydraulic springs and braces whereby the unit is reliable yet is easily moved and operated and maintained. The system is free standing; therefore, it is not necessary to place a heavy object, such as a desk, drawing table, clothes storage unit, or the like on the base unit to anchor it to the bed unit.

The free standing feature is accomplished by the force exerted by the hydraulic units on the rear support legs connected to the bed unit, plus the weight of the base unit. The design counterbalances the weight of the bed unit, stabilizes the system when the bed is in the overhead raised position, and makes it possible to swing or float the bed up and over a desk, drawing table, clothes storage unit, or the like in one simple movement with very little effort and fold it down with very little effort.

BRIEF DESCRIPTION OF THE DRAWING FIGURES

DETAILED DESCRIPTION OF THE PREFERRED EMBODIMENT OF THE INVENTION

Figure 1:
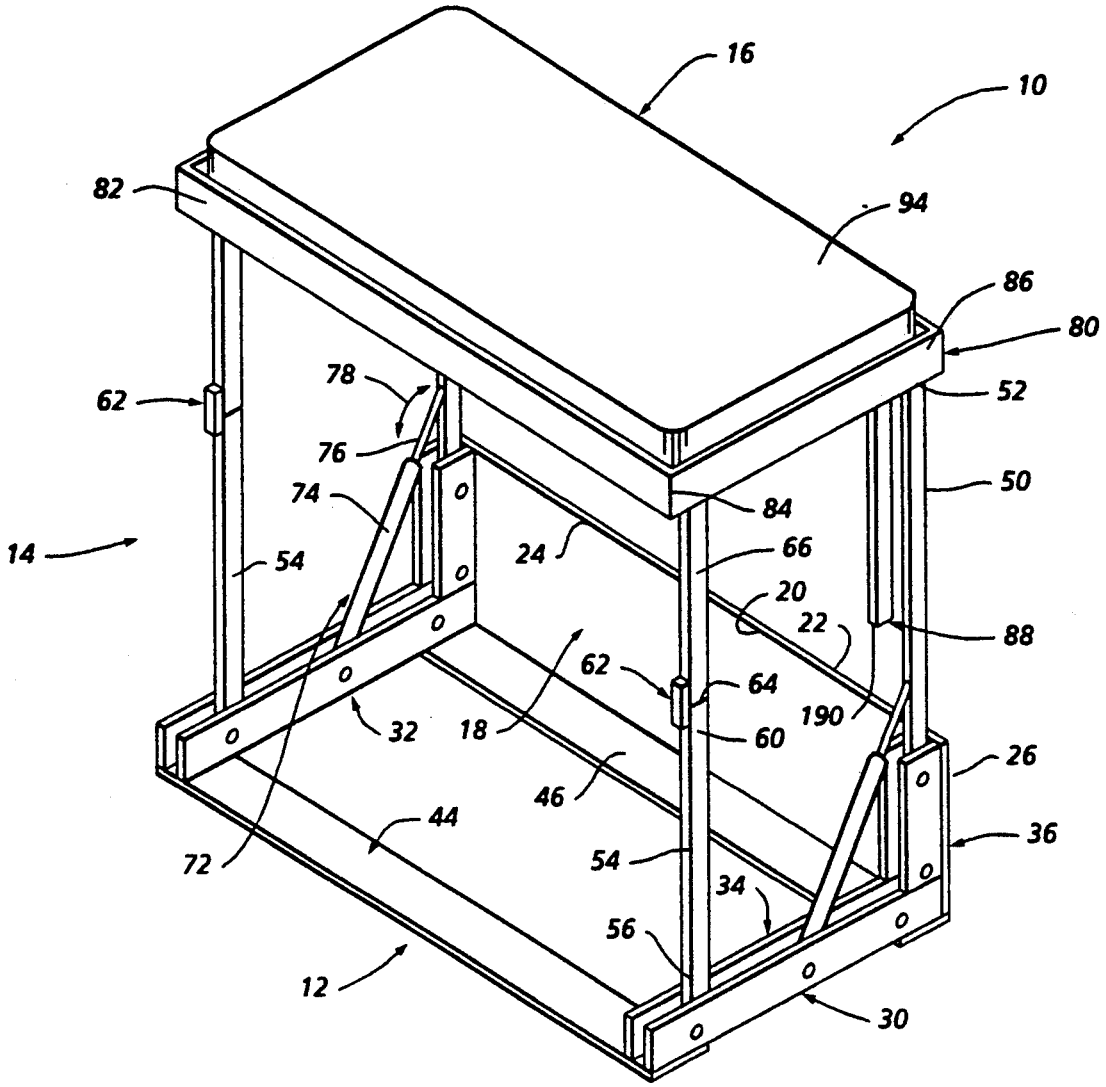
FIG. 1 is top, end and front perspective view of an elevation bed embodying the present invention in an elevated, stored condition.
Figure 2:
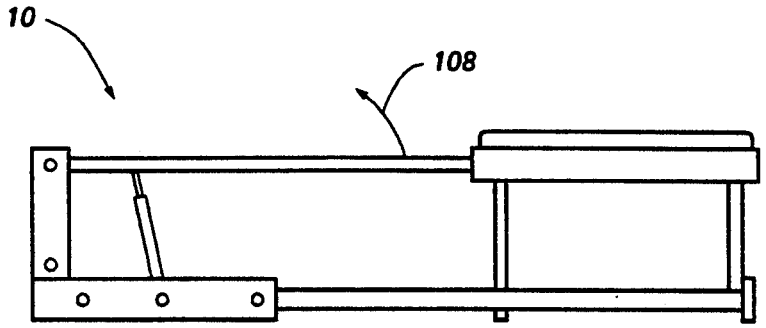
FIG. 2 is an end elevational view of the bed in a lowered, in-use condition, it being noted that the support legs connecting the base unit and the bed unit can slope slightly upward from the floor.

Shown in FIGS. 1 and 2 is a space saving bed system 10 embodying the present invention in the elevated, stored configuration and in the lowered, in-use configuration, respectively. The system 10 includes a base unit 12 and a bed unit, and a leg system 14 that connects bed unit 16 to the base unit. As shown in FIGS. 1 and 2, the bed is stored in an overhead location whereby the space beneath the bed can be used for a desk, a drawing table, a clothes storage unit, or the like. The base unit need not be fixed to the floor or to a wall. Since the bed 10 is not permanently fixed to a wall or to a ceiling or to a floor, the bed can be easily moved if necessary or desired. As will be seen from the ensuing disclosure, the elements of the bed are connected together by simple fasteners, so the bed can be easily assembled and dismantled using readily-available tools. This feature will also permit the bed to be sold at a lower price than other beds that may require a great deal of assembly and difficult installation.

Figure 3:
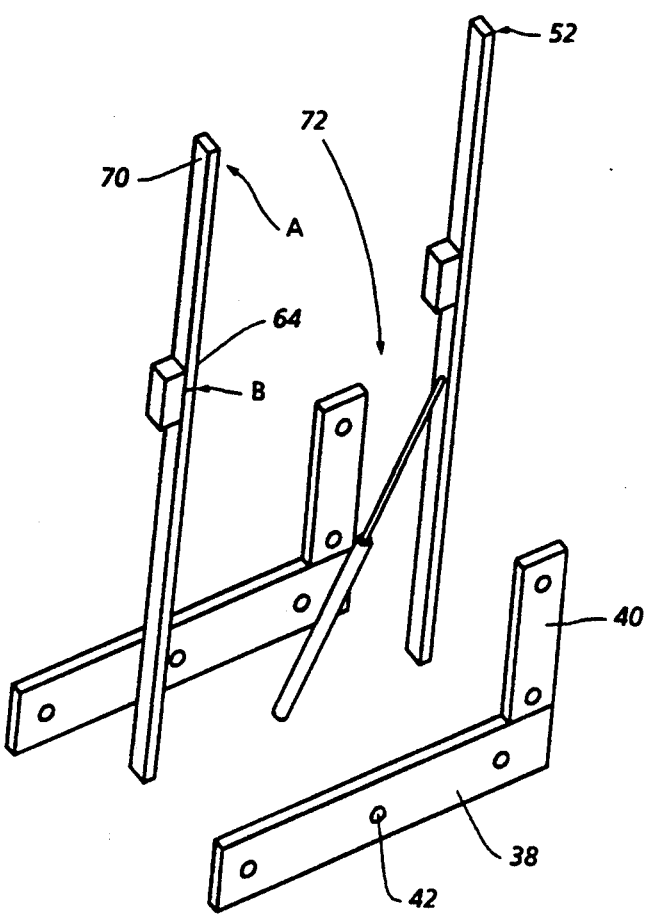
FIG. 3 is a perspective view of the elements of the base unit and leg unit of the elevation bed of the present invention.

More specifically, referring to FIGS. 1, 2 and 3, it is seen that the base unit 12 includes a shear panel element 18 that has a front surface 20, a rear surface 22, a top side edge 24, a bottom side edge, a first end 26 and a second end. In the preferred form, the panel element is rectangular, but could be other suitable shapes. The plate element is also wood or other heavy material in the preferred form of the space saving bed.

The base unit 12 further includes a floor standing section that includes two L-shaped brackets 30 and 32. The L-shaped brackets are identical, and each includes a long leg 34 located to abut a floor, and a short leg 36 located to abut the front surface 20 of the panel element 18 adjacent to one of the panel element ends. As is best shown in FIGS. 1 and 3, each L-shaped bracket is formed of two identical L-shaped elements 38 and 40. Each of the elements 38 and 40 is rectangular, with element 40 being shorter than the element 38 and having one end thereof abutting one side edge of the long element adjacent to one end of that long element to form the L shape. The elements 38 and 40 are fixed together, or can be formed as a one-piece item if suitable. The elements 38 and 40 of each L-shaped bracket are connected together by fasteners extending through fastener-receiving holes, such as hole 42 shown in element 38 in FIG. 3. A co-operating fastener-receiving hole is defined in a co-operating element to receive the fastener to form the L-shaped bracket shown in FIG. 1.

Two identical cross brace elements 44 and 46 connect the L-shaped brackets together. Each cross brace element is rectangular and extends from one L-shaped element to the other.

The leveraged fold out leg system 14 includes two rear legs 50 each connected at one end thereof to a short leg of a base unit L-shaped bracket and which extend upwardly from the base unit. Each rear leg includes a second end 52 spaced above the L-shaped brackets. In the preferred embodiment, the rear legs are co-equal in length so the second ends thereof are co-planar with each other. The purpose of such co-planar positioning of the rear leg second ends will be understood from the ensuing discussion. The L-shaped brackets are attached to the shear panel element by suitable fasteners.

The leg system 12 further includes two front support legs 54. The front legs are identical to each other, and each has one end 56 thereof attached to an L-shaped bracket long leg at a location spaced from the end of that bracket long leg. Each front leg further includes a second end 60 that is located above the L-shaped bracket and which is spaced from the L-shaped bracket short leg.

The support leg system further includes a hinge element 62 fixed to each second leg adjacent to that leg second end. The hinge elements are shown in block form in FIG. 1 for the sake of convenience, but will be discussed in greater detail below with reference to FIGS. 4A and 4B. These blocks are short pieces of tubing attached to the two front bed legs. Their primary purpose is to align the two parts of the front support legs. Also, they extend the length of the two front bed legs so that all four bed legs attached to the bed frame are equal in length . Thus, the bed is horizontal and level in the lowered use position. The hinge elements pivotally connect the two front legs of the bed unit to two identical front legs connected to the base unit L-shaped brackets. The front legs are of such lengths to position the top ends 70 in a common plane with the rear leg top ends 52.

Figure 6:
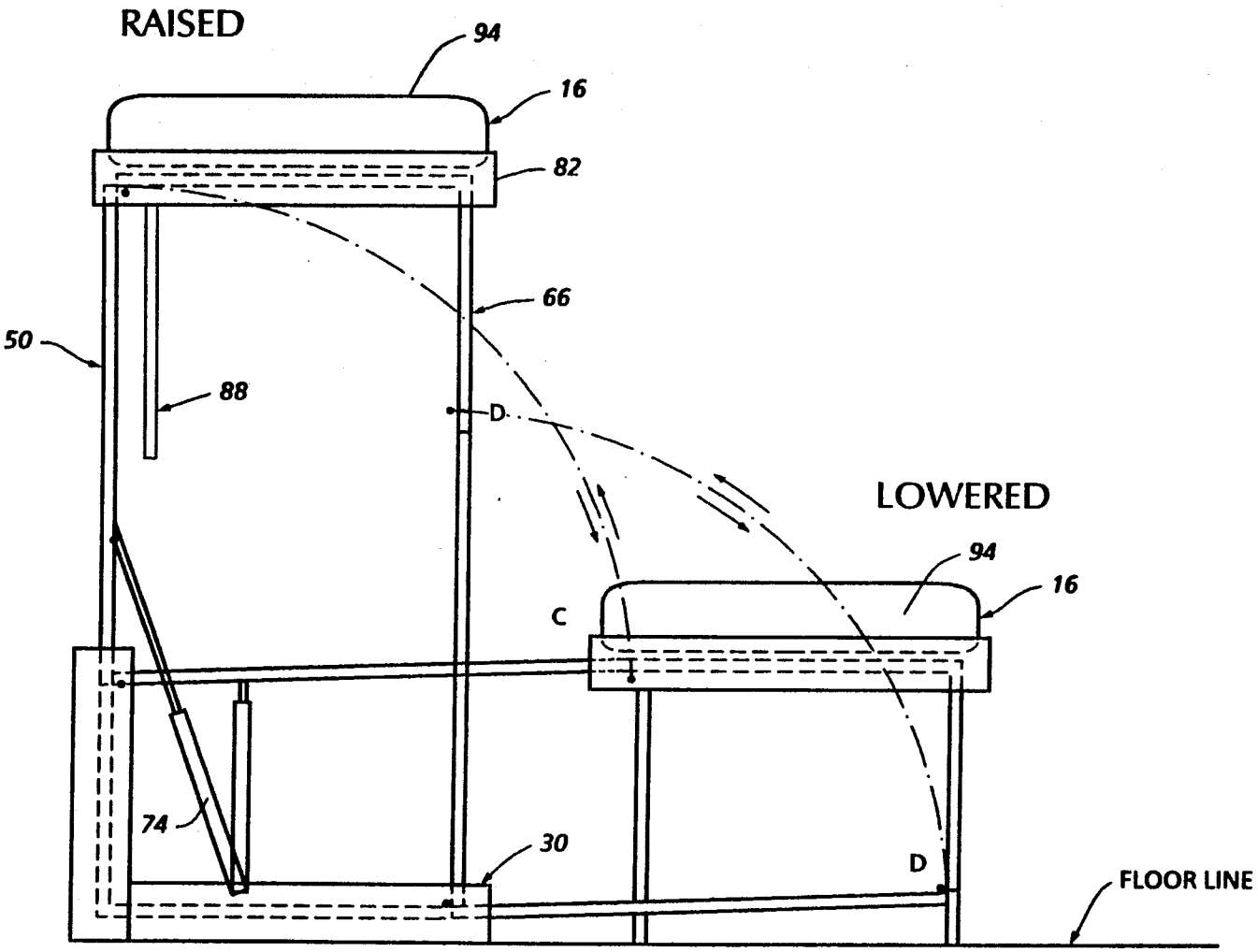
FIG. 6 illustrates the path travelled by the bed unit as it is raised and/or lowered.

The leg system further includes two identical hydraulic springs 72. Each hydraulic spring 72 includes a cylinder element 74 connected at one end thereof to an L-shaped bracket long leg at a location spaced from the short leg, and a piston arm 76 extending out of the other end of the cylinder element and being pivotally fixed to the rear leg associated therewith at a location spaced from the rear leg first end. The cylinder housing is also pivotally connected to the L-shaped bracket to permit proper movement of the legs with respect to each other as will be understood from the present disclosure. The hydraulic springs include hydraulic fluid in the cylinder, suitable valves and the like to permit the rear legs to be moved to and away from the L-shaped bracket long legs under the control of the hydraulic springs. Such movement is indicated in FIGS. 1 and 6 by arrow 78 in FIG. 1. The L-shaped bracket short leg forming elements are connected together in a manner that permits the rear leg to move in this manner.

The bed unit 16 includes a bed frame element 80 with four bed legs of equal length attached that has a bedding-supporting elements surrounded by a wooden frame 82 to keep the bedding in place. The preferred form of the space saving bed includes a rectangular bed frame element having front corners 84 and rear corners 86. Two rear bed legs 88 are attached at a first end thereof to the bedding-supporting element and have second ends 90 thereof spaced from the rear legs and from the L-shaped bracket elements in the overhead stored condition shown in FIG. 1.

The rear leg second ends are co-planar with the rear leg second ends and all such ends are fixed to the mattress-supporting element. The mattress-supporting element is thus supported by the leg system and is connected thereby to the base unit. A suitable sleeping bedding, mattress and other bedding items 94, is supported in the frame unit.

As indicated above, the front legs of the leg system are connected together by hinges 62. These hinges permit the front legs to bend from the FIG. 1 configuration to the FIG. 3 configuration, but lock the legs in the FIG. 1 configuration when suitable.

Figure 4A:
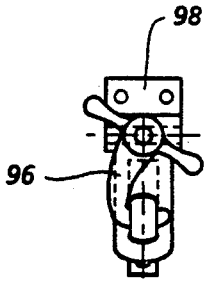
FIG. 4 is a front elevational view of a handle and hasp hinge that is used on the leg unit of the elevation bed of the present invention.
FIG. 4B is a side elevational view of the handle and hasp hinge.
Figure 4B:
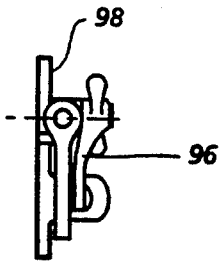

The front legs of the leg system are made up of two identical legs connected to the long legs of the L-shaped base unit brackets and the two front legs of the bed. The locking hinges join together the upper and lower parts of the front legs. While it may be preferred in some instances to have locking hinges on all four legs, it is not necessary in all instances. The preferred form of locking hinge is shown in FIGS. 4A and 4B which includes a hinge handle 96 co-operating with a hinge hasp 98. The handle is mounted on one of the legs and the hasp is mounted on the other leg. Suitable bearings can also be included between the legs to permit those legs to pivot with respect to each other. When the legs are coaxial as shown in FIG. 1, the handle is engaged with the hasp to lock the legs into the FIG. 1 orientation. The hinges can be self-locking that must be unlocked manually before the bed can be folded down to the floor for sleeping as a safety measure.

Figure 5:
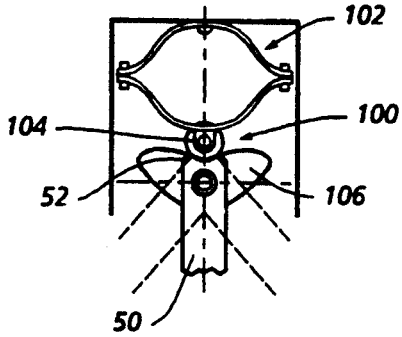
FIG. 5 is a front elevational view of a spring hinge that is used to connect a leg to a bed unit of the elevation bed.

As can be seen by comparing FIG. 1 to FIG. 2, the first legs pivot with respect to the bed unit as that bed unit moves from the FIG. 1 to the FIG. 3 configuration. A suitable pivot hinge is used to attach the legs to the bed unit. A preferred form of the pivoting hinge is shown in FIG. 5 as a spring hinge 100. The spring hinge 100 includes a spring element 102 mounted in a suitable bore in the bed frame unit. A roller 104 is mounted on the spring, and is pivotally attached to the leg second end 52. A cam 106 is also mounted on the leg second end and presses against the roller to control relative movement of the leg and bed frame during movement between the FIG. 1 and FIG. 2 positions. Other suitable over-center hinge connections can also be used to attach the legs to the bed frame unit.

The space saving bed system 10 is thus placed on a floor. The bed unit 16 is moved into he stored overhead FIG. 1 position from the lowered in-use FIG. 2 position by simply swinging the bed unit up and over a desk, drawing table, clothes storage unit, or the like in one safe and easy movement. Movement of the bed unit is controlled by the hydraulic units and the pivot hinges. Once the bed is in the FIG. 1 position, the hinges on the front legs of the leg system are locked and the bed unit is out of the way thereby clearing floor space beneath that bed unit.

It is also noted that the system disclosed herein can be used in many applications, including, but not limited to storing a work table over a bed, a kitchen table over a pre-manufactured kitchenette, a bed over another bed and the like. The system is free standing, not fastened to a floor, walls or ceiling, and the bed or other items can be at floor level and can be raised to above other items while remaining horizontal and lowered from a raised position to the floor with very little effort in one simple movement, without the use of pulleys, cables, or complicated mechanisms. Supports associated with the system can be adjusted to suit ceiling or other height. The system lends itself to the Ready-To-Assemble furniture industry because of its simplicity and minimum number of parts. Sleeping at floor level eliminates the hazards of climbing ladders as used with bunk beds, and eliminates the hazard of falling out of a raised bed or the upper bunk of bunk beds. The inventive system can be used in many situations, including college dorm, small apartments, and the like.

It is understood that while certain forms of the present invention have been illustrated and described herein, it is not to be limited to the specific forms or arrangements of parts described and shown.

I claim:

1. A space saving bed system comprising:

A) a base unit that includes (1) a plate element, and (2) a floor engaging section that includes (a) two L-shaped brackets, each having a long leg and a short leg, (b) first fastening means securing said bracket short legs to said plate element, and (3) cross brace elements connecting said bracket long legs together;

B) a leg system that includes (1) two front legs each connected at one end thereof to a bracket short leg and having a second end spaced from said short leg, (2) two rear legs each connected at one end thereof to a bracket long leg at a location spaced from the short leg of that bracket, (3) a hinge element connected to each rear leg at a second end of said rear leg, (4) two third legs each connected at one end thereof to a hinge element and having a second end spaced from said hinge element and from said front leg second ends;

C) two hydraulic cylinder units, each hydraulic cylinder unit including (1) a cylinder housing pivotally attached at one end thereof to a bracket long leg adjacent to the short leg of that bracket, and (2) a piston arm having one end connected to said cylinder housing and a second end pivotally attached to a front leg adjacent to said front leg one end; and D) a bed unit that includes (1) a frame element attached to said front leg second ends and to said third leg second ends, and (2) two bed legs each being attached at one end thereof to said frame element.

2. The space saving bed system defined in claim 1 wherein said front leg second ends and said third leg second ends are all co-planar with each other.

3. The space saving bed system defined in claim 2 wherein each of said hinge elements includes a hinge handle and a hinge hasp.

4. The space saving bed system defined in claim 2 wherein each of said hinge elements includes a spring hinge.

5. The space saving bed system defined in claim 4 further including a bed unit hinge element connecting each front leg second end to said unit frame element.

6. The space saving bed system defined in claim 5 wherein each bed unit hinge element includes a spring hinge.

7. The space saving bed system defined in claim 6 wherein each spring hinge includes a spring, a roller, on said spring and a cam element.

8. The space saving bed system defined in claim 7 wherein each L-shaped bracket has two identical L-shaped elements and means connecting said L-shaped elements together.

9. The space saving bed system defined in claim 8 wherein each front leg is sandwiched between L-shaped elements.

10. The space saving bed system defined in claim 9 further including a mattress-supporting element in said bed unit.

11. A space saving bed system comprising:

a bed unit including a bedframe a base unit that includes:

two L-shaped floor engaging brackets, each having a short leg and a long leg, a shear plate element attached to the short legs of the L-shaped brackets for fixing a rear distance between the brackets and to act for counterbalancing the weight of the bed unit, two cross brace elements attached to the long legs of the L-shaped brackets for fixing a front distance between the brackets and to act for counterbalancing the weight of the bed unit;

a leveraged fold out leg system that includes:

two rear legs each connected at one end thereof to an L-shaped bracket short leg and having a second end connected to a rear side of the bed frame, two front legs made up of identical pieces joined to the bed frame by locking hinges, and connected at one end thereof to an L-shaped bracket long leg and having a second end connected to a front side of the bed frame;

a said bed unit includes:

a rectangular frame element attached to the rear leg second ends and to said front leg second ends, and four bed legs of equal length, one attached to each corner of the bed frame element said front legs being connected to two of said four bed legs; and two hydraulic cylinder units, each unit including:

a cylinder housing pivotally attached at one end thereof to an L-shaped bracket long end adjacent to the short leg of that bracket, and a piston arm having one end connected to said cylinder housing and a second end pivotally attached to a rear leg adjacent to said rear leg one end.

12. The space saving bed unit defined in claim 11 wherein said rear leg second ends and said front leg second ends are all co-planar with each other.

13. The space saving bed unit defined in claim 12 wherein each locking hinge on the front legs of the leg system connecting the bed unit to the base unit includes a hinge handle and a hinge hasp.

14. The space saving bed unit defined in claim 13 wherein the hinges on the legs of the leg system connecting the bed unit to the base unit include means for allowing the legs to bend as the bed is swing between a lowered in-use position and a stored overhead position.

15. The space saving bed unit defined in claim 14 wherein the rear legs of the leg system and the front legs of the leg system are connected to the bed frame by hinges.

16. The space saving bed unit defined in claim 15 wherein a bed board frame is attached to the bed frame and surrounds the bedding to keep it in place as the bed is being slept on in the position and the stored overhead position.

17. The space saving bed unit defined in claim 16 further including means for fastening the bed board surrounding the bedding to the bed frame.

* * * * *